US009618294B2

(12) United States Patent
McPherson

(10) Patent No.: US 9,618,294 B2
(45) Date of Patent: Apr. 11, 2017

(54) CROSSBOW WITH STEP

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/022,994

(22) Filed: Sep. 10, 2013

(65) Prior Publication Data

US 2014/0069404 A1 Mar. 13, 2014

Related U.S. Application Data

(60) Provisional application No. 61/699,197, filed on Sep. 10, 2012.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)

(58) Field of Classification Search
CPC ..... F41B 5/12; F41B 5/00; F41B 5/1469
USPC ..... 124/25
See application file for complete search history.

(56) References Cited

U.S. PATENT DOCUMENTS

| | | | | |
|---|---|---|---|---|
| 577,641 | A | 2/1897 | Bruder | |
| 2,500,509 | A | 3/1950 | Bailey | |
| 2,609,810 | A | 9/1952 | Gruner | |
| D283,637 | S | 4/1986 | Williams | |
| 4,587,944 | A | 5/1986 | Barnett | |
| 4,649,891 | A | 3/1987 | Bozek | |
| 4,693,228 | A | 9/1987 | Simonds et al. | |
| 4,722,318 | A | 2/1988 | Yankey | |
| 4,879,987 | A | 11/1989 | Nishioka | |
| 5,720,268 | A * | 2/1998 | Koltze | 124/25 |
| 6,560,911 | B2 | 5/2003 | Sharp | |
| 6,651,641 | B1 | 11/2003 | Bower et al. | |
| 6,901,921 | B1 * | 6/2005 | Barnett | 124/25 |
| 7,174,884 | B2 | 2/2007 | Kempf et al. | |
| 7,328,693 | B2 | 2/2008 | Kempf | |
| 7,363,921 | B2 | 4/2008 | Kempf | |
| 7,708,001 | B2 | 5/2010 | Kempf | |
| 7,832,386 | B2 | 11/2010 | Bednar et al. | |
| 7,836,871 | B2 | 11/2010 | Kempf | |
| 7,930,849 | B2 | 4/2011 | Abraham et al. | |
| 2002/0020403 | A1 | 2/2002 | Troubridge | |
| 2005/0279338 | A1 | 12/2005 | Dziekan | |
| 2007/0006554 | A1 * | 1/2007 | Chang | 54/47 |
| 2007/0101631 | A1 | 5/2007 | Bentley | |
| 2007/0289190 | A1 | 12/2007 | Oz | |
| 2008/0168969 | A1 | 7/2008 | Kempf | |

(Continued)

*Primary Examiner* — Melba Bumgarner
*Assistant Examiner* — Amir Klayman

(57) ABSTRACT

In one or more embodiments, a prod may include a rail-engagement portion configured to engage a rail extending along a longitudinal axis extending proximally from the rail-engagement portion; a peripheral surface including a foot-engagement region; and, optionally, a bow-engagement portion configured to engage a bow or a bow limb. In one or more embodiments, prod or crossbow accessory engages a crossbow, wherein the prod or crossbow accessory includes a first foot-engagement region and a second foot-engagement region.

4 Claims, 14 Drawing Sheets

(56) References Cited

U.S. PATENT DOCUMENTS

| | | | | |
|---|---|---|---|---|
| 2008/0196363 | A1* | 8/2008 | Chang | B68C 3/00 54/49 |
| 2009/0194086 | A1 | 8/2009 | Kempf | |
| 2010/0116259 | A1 | 5/2010 | Popov et al. | |
| 2010/0186728 | A1 | 7/2010 | Bednar et al. | |
| 2010/0269807 | A1 | 10/2010 | Kempf | |
| 2011/0016764 | A1 | 1/2011 | Cales | |
| 2011/0203561 | A1 | 8/2011 | Shaffer et al. | |
| 2011/0232619 | A1 | 9/2011 | Bednar et al. | |
| 2013/0061836 | A1* | 3/2013 | Kempf | 124/25 |

* cited by examiner

CROSSBOW WITH STEP

CROSS-REFERENCE TO RELATED APPLICATIONS

The application claims the benefit of U.S. Provisional Patent Application No. 61/699,197, filed Sep. 10, 2012, the entire content of which is hereby incorporated herein by reference.

BACKGROUND

This invention relates generally to crossbows, and more particularly to prods and/or stock accessories.

Crossbows are generally known in the art. Crossbows typically include a bow assembly portion mounted on a stock portion, which typically includes a string latch and trigger assembly for holding a drawn crossbow string and selectively releasing it.

Crossbows have employed foot stirrups disposed beyond the end of the stock portion. Foot stirrups have been fixedly engaged to the bow assembly portion or stock portion. A user may place the foot stirrup on the ground and place their foot in the foot stirrup, thus holding the foot stirrup and forward end of the stock portion in place. The user can then apply a drawing force to the crossbow string, to draw the string toward the string latch assembly to cock the crossbow. The crossbow string is held by the sting latch in a drawn configuration.

Crossbows that employ foot stirrups tend to be larger (e.g., by weight, by volume, overall length, etc.) and/or more cumbersome due to the protruding foot stirrups, which may be permanently engaged with the stock assembly. For example, a crossbow that includes a protruding foot stirrup may be more difficult to store, transport, and/or operate.

There remains a need for novel crossbow designs that provide benefits over the prior art. For example, there remains a need for crossbows having a shorter length. Also, for example, there remains a need for crossbows that can be drawn safely.

All U.S. patents and applications and all other published documents (including foreign patents and applications) mentioned anywhere in this application are incorporated herein by reference, each incorporated herein in its entirety.

Without limiting the scope of the claimed subject matter a brief summary of some of the claimed embodiments is set forth below. Additional details of the summarized embodiments and/or additional embodiments may be found in the Detailed Description below.

A brief abstract of the technical disclosure in the specification is provided as well only for the purposes of complying with 37 C.F.R. 1.72. The abstract is not intended to be used for interpreting the scope of the claims.

BRIEF SUMMARY

In one or more aspects of the present disclosure, a prod may include a rail-engagement portion configured to engage a rail extending along a longitudinal axis extending proximally from the rail-engagement portion and a peripheral surface comprising a foot-engagement region.

In one or more embodiments, a prod may further include a bow-engagement portion configured to engage a bow or a bow limb. The bow-engagement portion may be configured to engage a bow or bow limb such that the bow or the bow limb extends laterally from the bow-engagement portion. The foot-engagement region may be disposed proximal of the bow-engagement portion. The bow-engagement portion may be configured to engage a bow that extends laterally from the prod.

In one or more embodiments, the foot-engagement region of a prod may be an integral portion of the prod.

In one or more embodiments, the peripheral surface including the foot-engagement region may face proximally.

In one or more embodiments, a foot-engagement region may include a substantially planar foot-engagement region surface. In one or more embodiments, the foot-engagement region surface may define a foot-engagement region plane, which may be, for example, perpendicular to the longitudinal axis of the rail.

In one or more embodiments, a foot-engagement region may include a non-skid foot-engagement region surface. For example, a foot-engagement region may include at least one foot-engagement protrusion and at least one recess. In one or more embodiments, the foot-engagement region may include a plurality of alternating foot-engagement protrusions and recesses.

In one or more embodiments, a foot-engagement region may include a first foot-engagement region surface and a second foot-engagement region surface. Each foot-engagement region may define a foot-engagement region plane (e.g., the first foot-engagement region surface may define a first foot-engagement region plane, the second foot-engagement region surface may define a second foot-engagement region plane, etc.). Two or more of the foot-engagement region planes may be substantially parallel or substantially coplanar.

In one or more embodiments, a first foot-engagement region surface may be configured to be engaged by a first foot or first foot garment and the second foot-engagement region surface may be configured to be engaged by a second foot or second foot garment.

In one or more embodiments, a first foot-engagement region surface may be disposed laterally from the rail-engagement portion. The second foot-engagement region surface may be disposed laterally from the rail-engagement portion of the prod on an opposing side of the rail-engagement portion from the first foot-engagement region surface. In one or more embodiments, at least one of the first and second foot-engagement surfaces may be dimensioned to receive a foot or a foot garment thereon.

In one or more aspects of the present disclosure, a crossbow may include a stock assembly and a bow assembly that includes a prod. A stock assembly may include a rail, a latch assembly, and a trigger assembly. In one or more embodiments, a rail may define a first longitudinal axis. In one or more embodiments, a latch assembly may be engaged with the rail and may be constructed and arranged to releasably hold a bow string in a cocked configuration. In one or more embodiments, a trigger assembly may be constructed and arranged to release a bow string from a latch assembly. In a crossbow of the present disclosure, a bow assembly may be operatively engaged with the stock assembly and may include a prod, a bow, and a crossbow string. A prod may include, for example, a first foot-engagement region and a second foot-engagement region, wherein both of the first and second foot-engagement regions extend in a common plane perpendicular to the longitudinal axis of the rail. In one or more embodiments, a bow may be operatively engaged with the prod and may include a first bow limb that has a first limb end and a second bow limb that has a second limb end. In one or more embodiments, a bow assembly may include a crossbow string operatively engaged with the first limb end and the second limb end.

In one or more embodiments a first foot-engagement region may be integral with the prod. In one or more embodiments, a first foot-engagement region may be disposed between the bow and the bow string.

In one or more embodiments of the present disclosure, a crossbow does not include a separate foot stirrup (e.g., a dedicated foot stirrup).

In one or more aspects of the present disclosure, a crossbow accessory may include a rail-engagement portion configured to engage a rail extending along a longitudinal axis extending proximally from the rail-engagement portion and a textured peripheral surface including at least two foot-engagement regions, wherein the at least two foot-engagement regions are disposed on opposing sides of the rail-engagement portion.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description is hereafter described with specific reference being made to the drawings.

DETAILED DESCRIPTION

Figure 1:
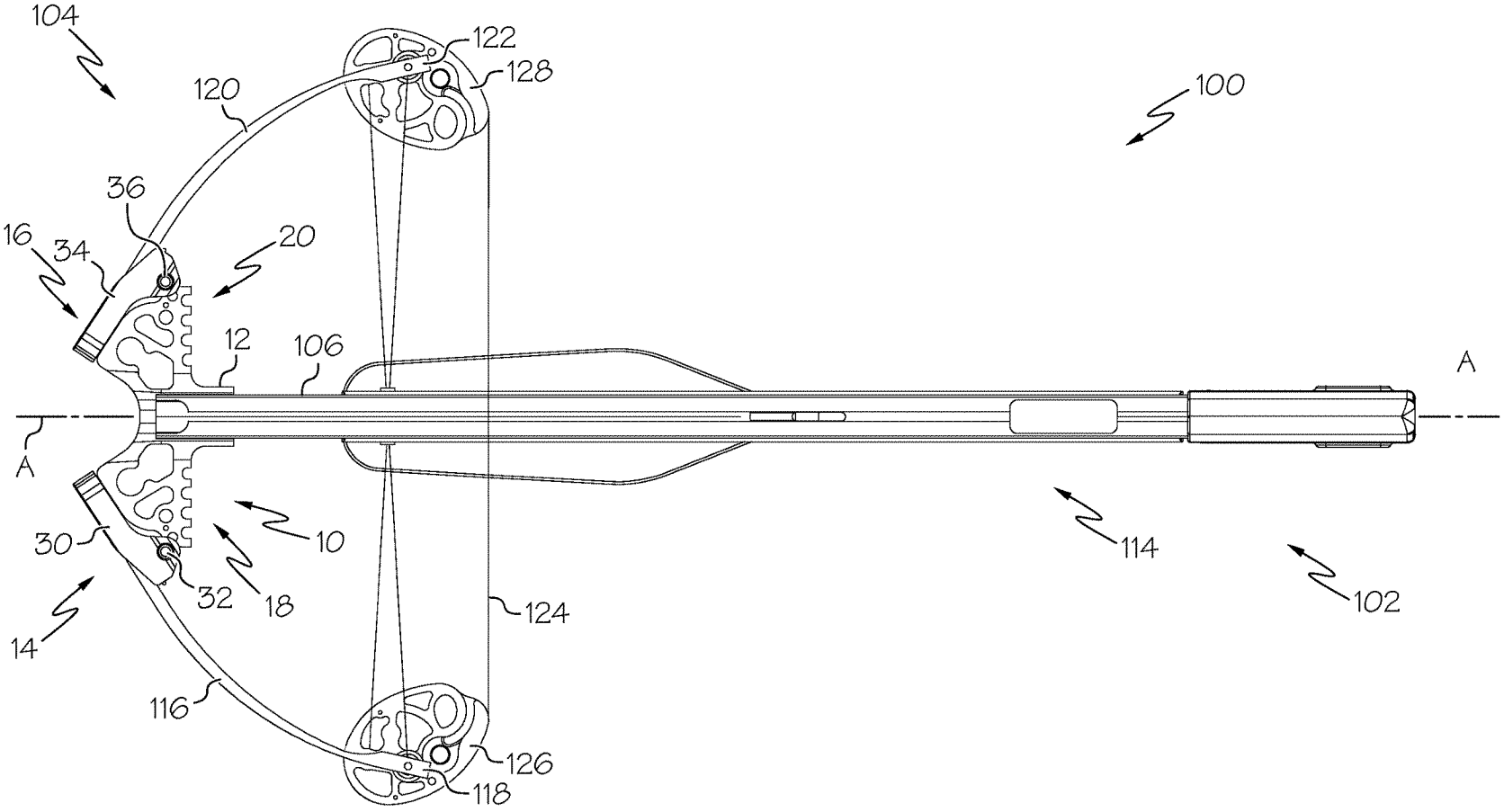
FIG. 1 is a top view of at least one embodiment of a crossbow including a prod according to the present disclosure.

While the subject matter of the present disclosure may be embodied in many different forms, there are described in detail herein one or more specific embodiments. This description is an exemplification of the principles of the present disclosure and is not intended to limit the present disclosure to the particular embodiments illustrated.

For the purposes of this disclosure, like reference numerals in the figures shall refer to like features unless otherwise indicated.

In one or more embodiments, with reference to FIG. 1, a crossbow 100 is shown including a prod 10. In one or more embodiments, prod 10 may include a rail-engagement portion 12 configured to engage a rail 106 extending along a longitudinal axis A (e.g., a central longitudinal axis) extending proximally from the rail-engagement portion 12. Prod 10 may also include a peripheral surface including one or more foot-engagement regions 18, 20 (e.g., first foot-engagement region 18, second foot-engagement region 20, etc.).

As shown in FIGS. 1-8, prod 10 may include a bow-engagement portion, which may be configured to engage a bow or a portion of a bow (e.g. limb). In the present disclosure, a prod may be configured with a recess or cavity in which a portion of a bow (e.g. limb) may be secured and through which a portion of a bow may extend. In one or more embodiments such as that shown in FIGS. 1-8, prod 10 may include a plurality of bow-engagement portions 14, 16, each of which may engage a bow limb 116, 120 (e.g., first bow limb 116, second bow limb 120, etc.). Bow-engagement portions 14, 16 may be configured to engage a bow or bow limb such that the bow or the bow limb extends laterally from the bow-engagement portion. In some embodiments, the prod 10 may be engaged with (e.g., attached to) rail 106 by a rigid moment connection. In some embodiments, the prod 10 may be engaged with (e.g., attached to) a bow limb 116, 120 by a rigid moment connection.

In the present disclosure, it should be noted that a prod is not necessarily required to transfer moment forces between multiple limbs. For example, if a continuous limb is used, which spans continuously from one side of the bow to the other (e.g. from axle-to-axle), a structural member that attaches to the continuous limb does not need to transfer moment forces.

Figure 2:
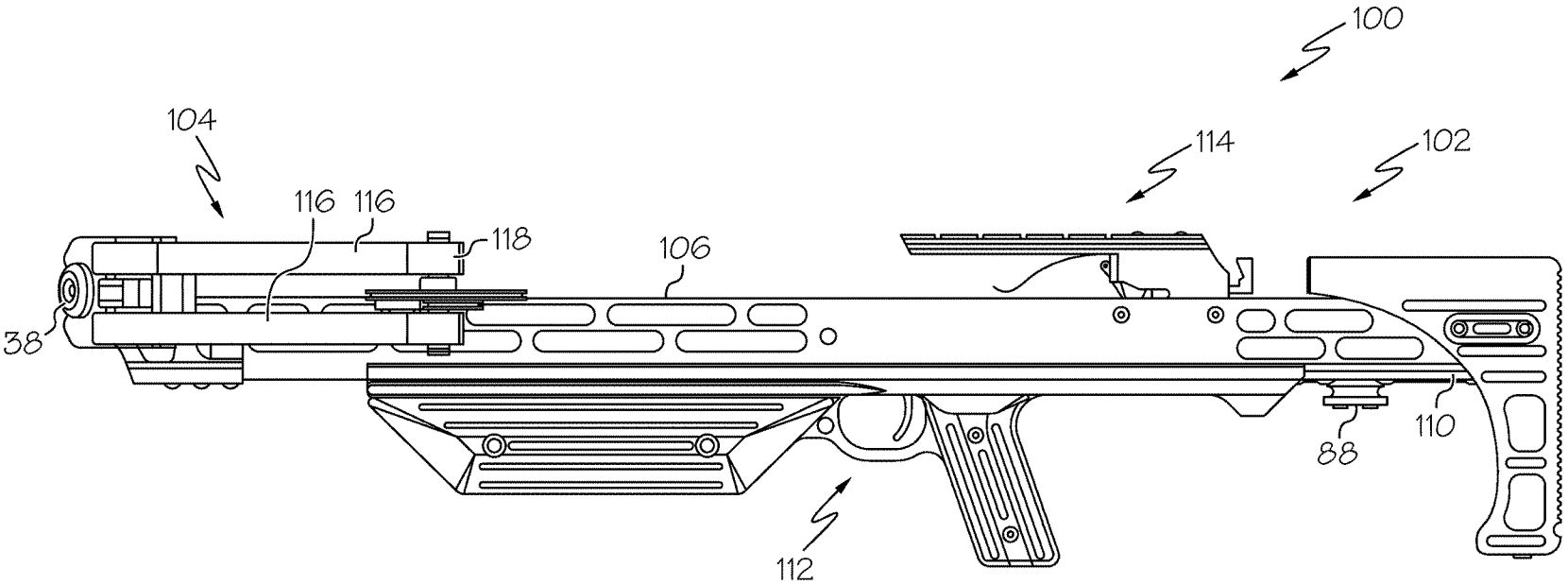
FIG. 2 is a side view (e.g., left side view) of at least one embodiment of a crossbow including a prod according to the present disclosure.

In the present disclosure, "front" refers to the end of a crossbow (or other component) that faces a target of an arrow to be shot by the crossbow. For example, in some embodiments, the front of rail 106 abuts prod 10 at stop 50. In the present disclosure, "rear" refers to the direction opposite of "front." In the present disclosure, "proximal of" may be used interchangeably with "in front of" and "distal of" may be used interchangeably with "in the rear of." That is, it may also be said that rail 106 is distal of stop 50, whereas stop 50 is proximal of rail 106, which extends between the distal end 108 (FIG. 1) of rail 106 and the proximal end 110 (FIG. 2) of rail 106. Further, "left" and "right" will refer to opposing "lateral" directions with respect to rail 106 or prod 10 (or other component) which faces left or right from the crossbow. For example, the left side of rail 106 is shown in FIG. 2. For another example, in FIG. 1, bow limb 116 extends laterally from first bow limb engagement portion 14 of prod 10. In the present disclosure, "top" refers to the direction that the portion of a crossbow (or other component) seen in FIG. 1 faces. "Bottom" refers to the direction opposite of "top." Herein, "vertical" refers to the up-down direction.

Generally, when a crossbow is drawn, a drawing force is applied to a portion of the bowstring 124 in the rear direction toward a latch assembly 114. As the bowstring 124 moves rearward, the limbs 116, 120 flex and store energy. The bow string 124 may be retained in a cocked position by the latch assembly 114 (FIG. 2). A trigger assembly (e.g., including a trigger) 112 may selectively release the string 124 from the latch assembly 114, which will allow the crossbow 100 to fire an arrow or bolt (not shown). In order to hold the crossbow in place while drawing, a counterforce must be applied in the forward direction to keep the rail 106 stationary.

Trigger assemblies are generally known in the art. For example, Darlington (U.S. Pat. No. 5,884,614) and Simonds (U.S. Pat. No. 4,693,228) each disclose exemplary suitable trigger assemblies, and each is hereby incorporated herein by reference in its entirety.

Figure 3:
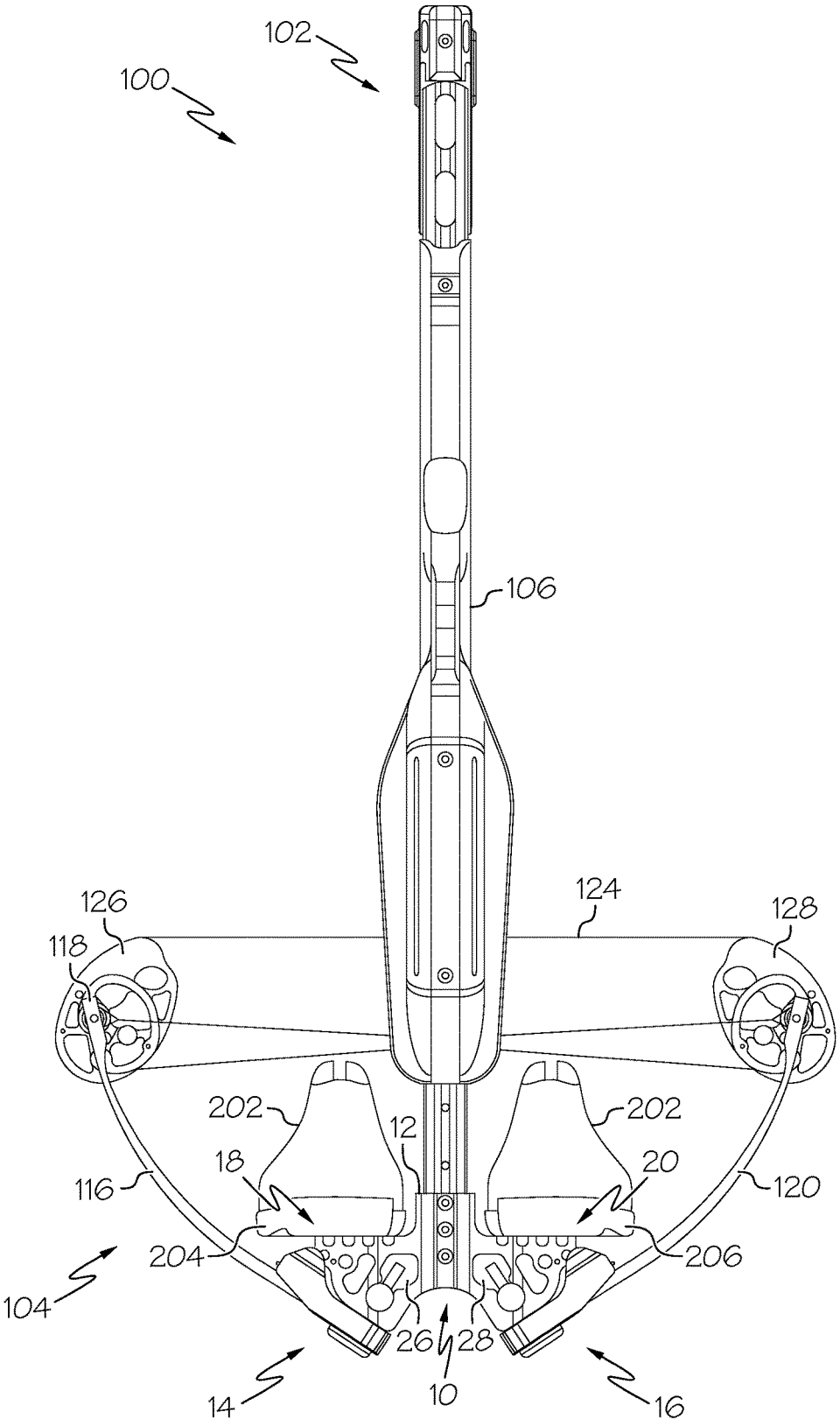
FIG. 3 is a bottom view of at least one embodiment of a crossbow including a prod according to the present disclosure, depicting two feet or foot garments engaging the prod.
Figure 4:
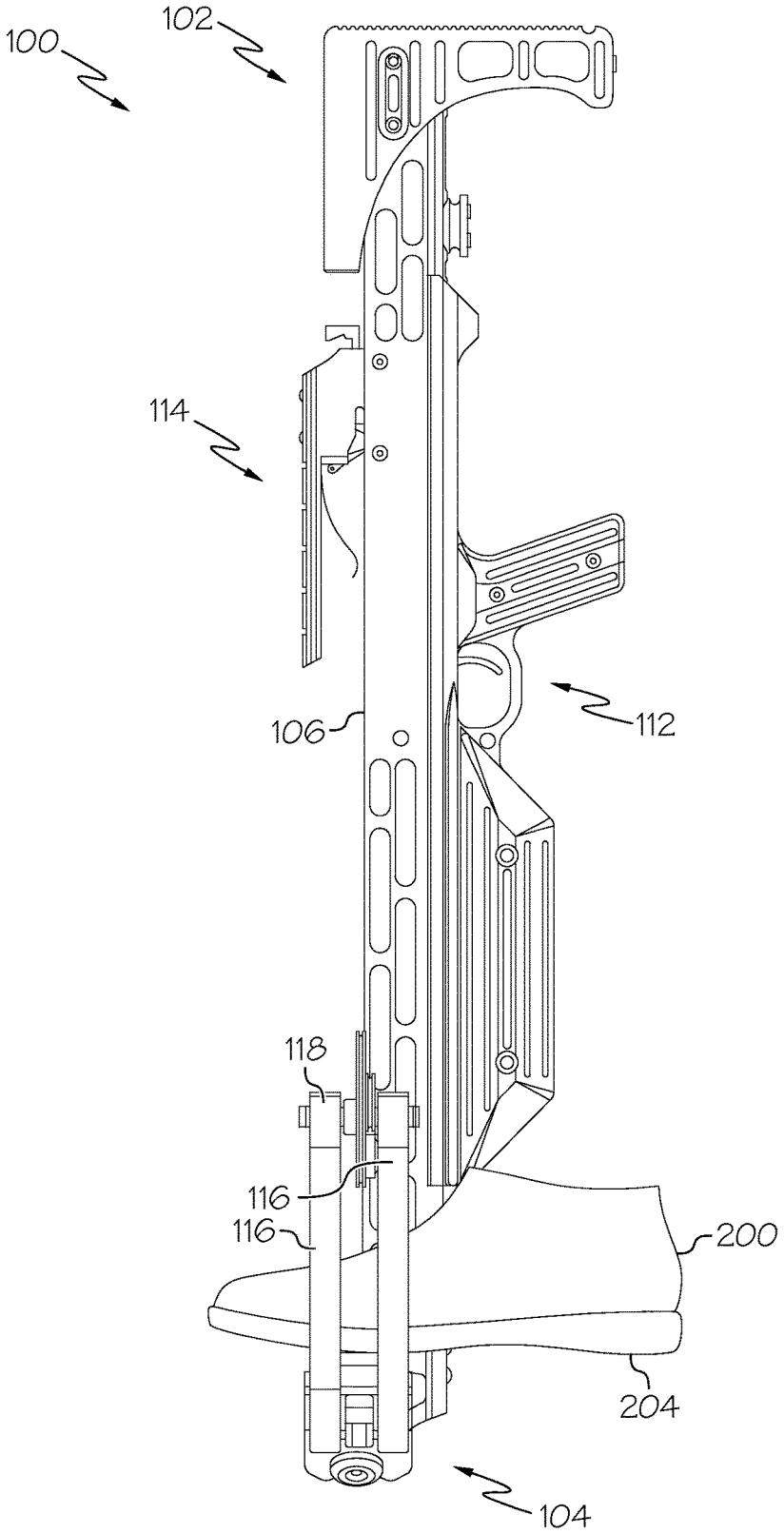
FIG. 4 is another side view (e.g., left side view) of at least one embodiment of a crossbow including a prod according to the present disclosure, depicting at least one foot engaging the prod.

FIGS. 3 and 4 show the positioning of a foot or foot garment 200, 202 disposed on a prod. For example, in FIG. 3, first foot or foot garment 200 is depicted as engaging foot-engagement region 18 of prod 10 and second foot or foot garment 202 is depicted as engaging foot-engagement region 20. In this manner, a crossbow hunter may brace one or both feet against prod 10, as shown in FIGS. 3-7 in order to provide a counterforce for drawing bow string 124 to be cocked.

It should be noted that, in some embodiments, foot-engagement region(s) 18, 20 may be disposed distal of the bow-engagement portion(s) 14, 16. That is, a foot-engagement region 18, 20 may be disposed between the bow-engagement portion(s) 14, 16 and the bowstring 124.

In the present disclosure, a bow-engagement portion 14, 16 may be configured to engage a bow portion that extends laterally from the prod 10. For example, as shown in FIGS. 1, 3, 6, and 8, each of bow-engagement portions 14, 16 is configured to engage one or more of the components that comprise bow limbs 116, 120, each of which extends laterally (e.g., in the left or right direction) from the prod 10.

In the present disclosure, one or more foot-engagement region(s) 18, 20 may be an integral portion of the prod 10 assembly. That is, in some embodiments, a prod 10 is of a unitary construction that includes a foot-engagement portion, a rail-engagement portion, and a bow-engagement portion. A prod 10 of the present disclosure may be constructed of any of a wide variety of materials that provide the requisite strength and durability in order to withstand the forces applied to it (e.g., forces imposed by a foot or foot garment, forces imposed by the rail or fasteners engaging the rail and prod, forces imposed by the bow or bow limbs in various configurations including at rest, cocking, drawn, and firing, etc.) when used, for example, as a component of a crossbow during an act of cocking the crossbow.

In the present disclosure, a foot-engagement region 18, 20 may include any of, for example, a platform, a foot pad, a foot support, a foot rest, a foot seat, a pedal, and the like.

Figure 9:
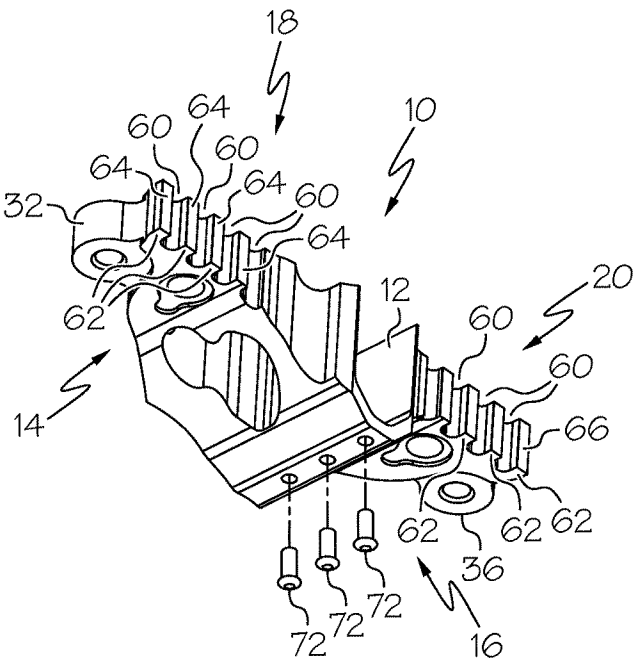
FIG. 9 is view C-C of FIG. 8, a left-bottom-rear exploded view of at least one embodiment of a prod according to the present disclosure, shown with three rail-engagement members (e.g., screws, bolts, etc.).

In one or more embodiments, a peripheral surface that includes one or more foot-engagement regions 18, 20 faces distally. As shown in FIGS. 3 and 5-7, prod 10 includes a peripheral surface that faces distally and that includes one or more foot-engagement regions 18, 20. As shown in FIG. 9, first foot-engagement region surfaces 64 face distally. In addition, second foot-engagement region surfaces 66 face distally.

Figure 8:
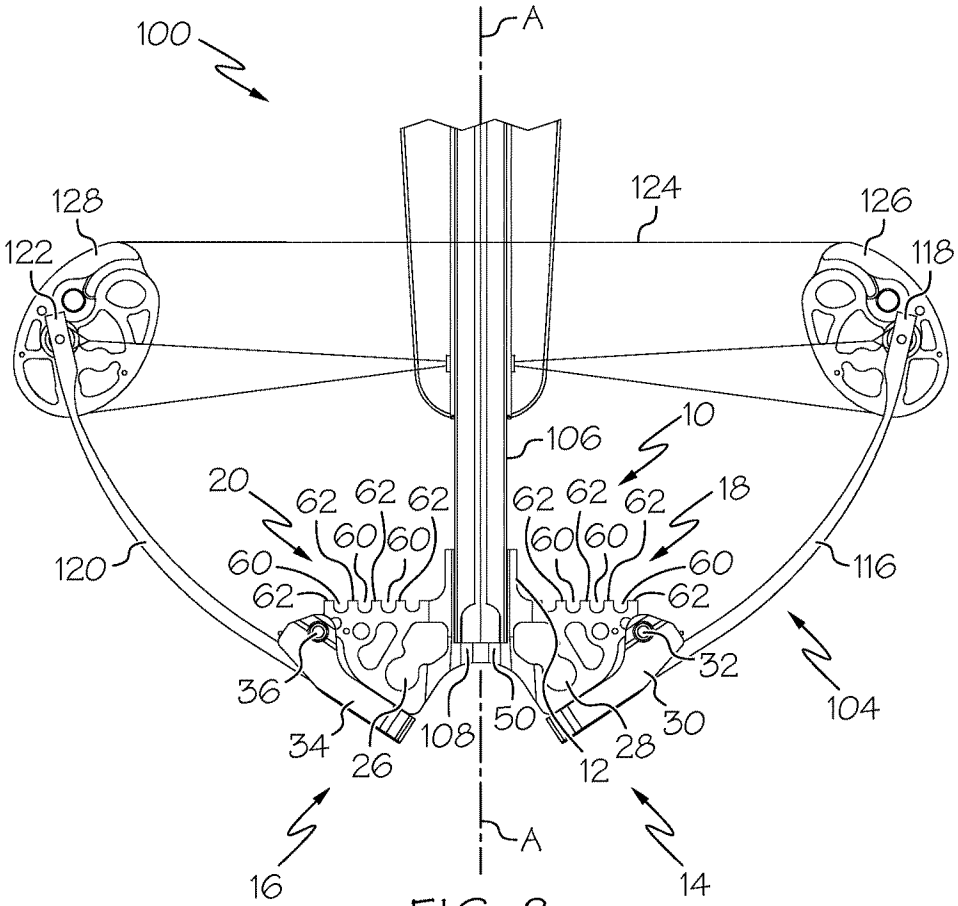
FIG. 8 is a top view of a portion of at least one embodiment of a crossbow including a prod according to the present disclosure.
Figure 10:
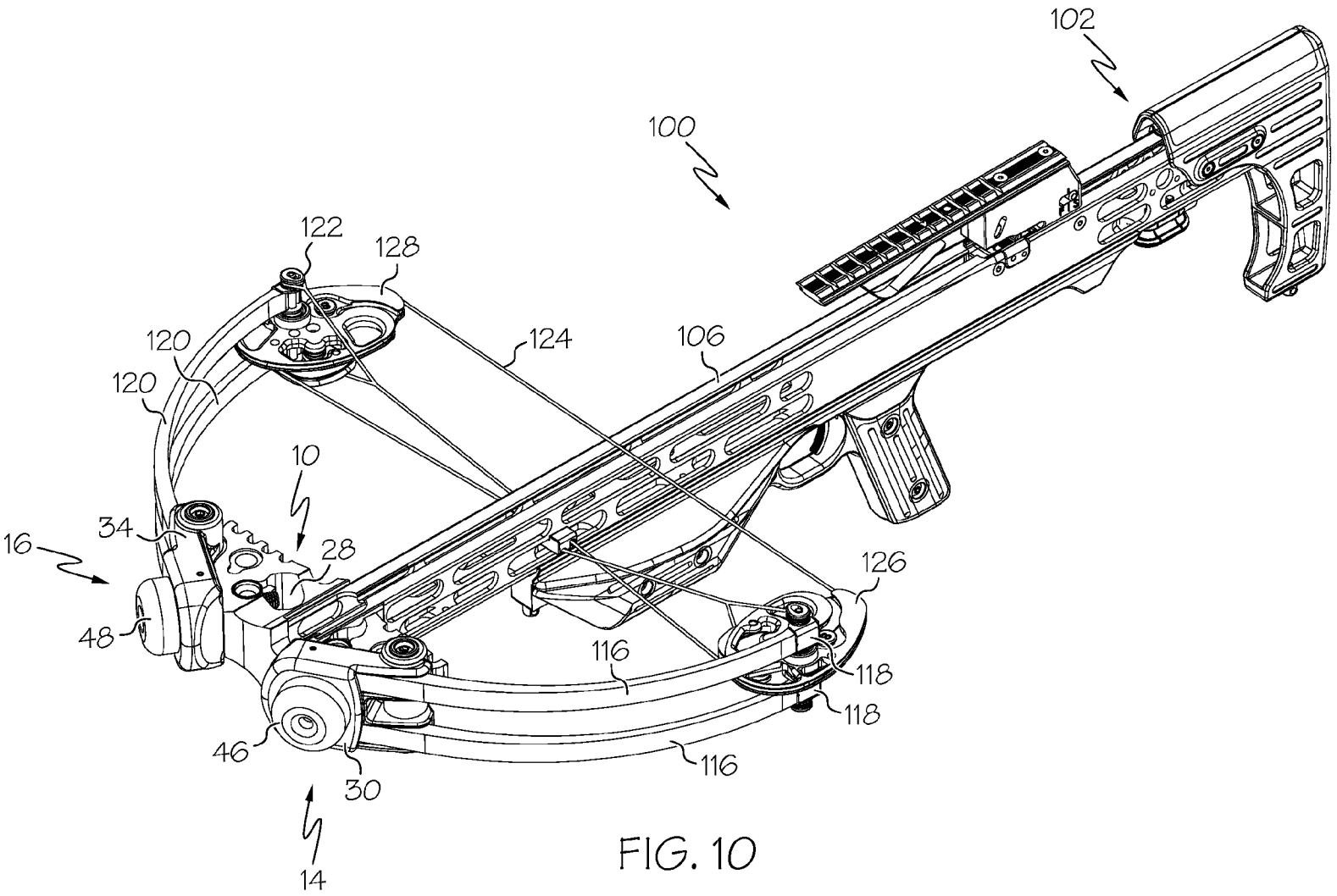
FIG. 10 is a left-top-front perspective view of at least one embodiment of a crossbow including a prod of the present disclosure, with arrows highlighting a foot-engagement portion of a prod and a cap, which may cover and/or protect the crossbow limb bolts and limb bolt washers when the crossbow is being cocked.

In one or more embodiments, a foot-engagement region 18, 20 may comprise a substantially planar foot-engagement region surface. For example, in FIGS. 8 and 9, a first foot-engagement region 18 includes a substantially planar foot-engagement region surface 64, defining a foot-engagement region plane. In one or more embodiments, a first foot-engagement portion 18 may include a plurality of substantially planar foot-engagement region surfaces 64, wherein the plurality of substantially planar foot-engagement region surfaces may or may not be coplanar. In FIGS. 8 and 9, the various first foot-engagement portion surfaces 64 are coplanar.

In one or more embodiments, a foot-engagement region plane may be perpendicular to the longitudinal axis of the rail 106 of the crossbow. For example, in FIG. 8, a foot-engagement region plane may be a plane defined by the first foot-engagement surfaces 64 and/or the second foot-engagement surfaces 66, which is perpendicular to longitudinal axis A of rail 106. In some embodiments, a foot-engagement region plane is orthogonal to the longitudinal axis A of the rail 106 of the crossbow.

In one or more embodiments, a prod 10 may include a plurality of foot-engagement region surfaces (e.g. 64) that are not coplanar (not shown) and/or are not perpendicular to the longitudinal axis A of the rail 106 (not shown).

The foot-engagement regions 18, 20 of the prods of the present disclosure may include a first foot-engagement region surface and a second foot-engagement region surface. In one or more embodiments, a first foot-engagement region surface may define a first foot-engagement region plane and a second foot-engagement region surface may define a second foot-engagement region plane, wherein the first and second foot-engagement region planes are substantially parallel. In some embodiments, the first and second foot-engagement region planes are disposed at equal but opposite angles to the longitudinal axis A of the rail 106. Alternatively, in some embodiments, the first and second foot-engagement region planes are not substantially parallel.

In some embodiments, the first and second foot-engagement region planes may be substantially coplanar.

In the present disclosure, the first foot-engagement region surface may be configured to be engaged by a first foot or first foot garment and the second foot-engagement region surface may be configured to be engaged by a second foot or second foot garment, as can be seen in FIGS. 3-7.

As shown in FIG. 9, a first foot-engagement region surface 64 may be disposed laterally from the rail-engagement portion 12. As can be seen in FIG. 9, a second foot-engagement region surface 66 may be disposed laterally from the rail-engagement portion 12 on an opposing side of the rail-engagement portion from the first foot-engagement region surface 64. In some embodiments, the first foot-engagement region comprises a mirror image of the second foot-engagement region. In some embodiments, surfaces 64 of the first foot-engagement region comprise mirror images of surfaces 64 of the second foot-engagement region, for example being symmetrical across a longitudinal axis of the prod 10.

In one or more embodiments of a prod 10 of the present disclosure, at least one of the first and second foot-engagement surfaces may be dimensioned to receive a foot or a foot garment thereon. For example, each foot-engagement region may have a lateral dimension of at least one half inch (e.g., at least 1 inch, at least two inches, at least three inches, at least 4 inches, at least 5 inches, at least 6 inches, etc.) In one or more embodiments, the lateral dimension of each foot-engagement region may be less than half of the span of the undrawn bow string, wherein the span is the distance between contact points of the bowstring with the rotatable members (e.g. in a compound bow) or limbs (e.g in a non-compound bow). For example, the lateral dimension of each foot-engagement region can be less than 40% of the undrawn bowstring length, less than 30% of the undrawn bow string length, etc. FIG. 8 shows first bow limb 116 having a first bow limb end 118. In FIG. 8, the lateral dimension of each foot-engagement region is less than a distance between the first bow limb end 118 and the rail 106.

A prod 10 of the present disclosure may include a foot-engagement region that includes a non-skid foot-engagement region surface. For example, a foot-engagement region may include at least one foot-engagement protrusion and at least one recess. In one or more embodiments, the foot-engagement region may include a plurality of protrusions separated by recesses. FIG. 8 shows prod 10 having a foot-engagement region 18, 20 having at least one (e.g., a plurality of) foot-engagement protrusion 62 and at least one (e.g., a plurality of) recess 64. In FIG. 8, a plurality of foot-engagement protrusions 62 alternate with recesses 60.

The alternating protrusion 62 and recess 60 structure can be oriented in any suitable direction. For example, FIG. 8 shows protrusions 62 and recesses 60 alternating in a lateral direction. This orientation is best suited to prevent a foot from slipping in a lateral direction. In some embodiments, protrusions 62 and recesses 60 alternate in a vertical direction (e.g. perpendicular to the orientation shown in FIG. 8. In some embodiments, protrusions 62 and recesses 60 alternate in both lateral and vertical directions (e.g. forming a grid). Additionally, such a grid surface can be made with any suitable orientation, such as having recesses 60 oriented as various angles to those shown in FIG. 8 (e.g. recesses 60 oriented 30 degrees, 45 degrees, 60 degrees, etc.) In some embodiments, intersecting protrusions 62, or recesses 60, need not be oriented orthogonal to one another but can be oriented at various angles to one another.

A foot-engagement region may, in one or more embodiments, include a series of elongated foot-engagement protrusions (e.g., ridges, etc.) alternating with a series of recesses (e.g., grooves, etc.). Foot-engagement protrusions may take a wide variety of shapes (e.g., nodules, ridges, webs, lattices, etc.). Similarly, recesses may take a wide variety of shapes that complement the shape of the foot-engagement protrusions. For example, in one or more embodiments in which the foot-engagement protrusions take the form of a web, a lattice, a honeycomb, or the like, the foot-engagement protrusions may be disposed individually between the webs, lattices, and honeycombs. In one or more embodiments in which the foot-engagement protrusions take the form of ridges, recesses alternating with the ridges may be elongated (e.g., grooves) and disposed between the ridges. If the foot-engagement protrusions are nodules, the recesses may surround the nodules in the form of a web, lattice, grid, honeycomb, or the like.

Foot-engagement protrusions and recesses of the foot-engagement regions may be configured to more securely engage a foot by, for example, reducing the likelihood of a foot slipping off of the foot-engagement region while cocking the crossbow. In one or more embodiments, the foot-engagement protrusions and recesses may correspond to the shape of the foot or foot garment of the crossbow user. For example, the foot-engagement regions may be constructed and shaped to correspond to the shape and/or topology of the sole of the crossbow user's foot or foot garment. In one or more embodiments, the foot-engagement protrusions and recesses in one foot-engagement region may be the same as or a mirror image of the foot-engagement protrusions and recesses in a second foot-engagement region. In one or more embodiments, it may be preferred that a foot-engagement region includes parallel and alternating ridges and grooves extending from the top of the foot-engagement region to the bottom of the foot-engagement region (e.g., perpendicular to the lateral directions), which may reduce slippage in the lateral directions. Alternating grooves and foot-engagement protrusions (e.g., ridges, etc.) may be oriented in any suitable direction (e.g., oriented any number of degrees from vertical).

In one or more embodiments, any of a wide variety of materials having enhanced gripping characteristics may be disposed within one or more recesses to provide additional contact surfaces (e.g., foot-engagement region surfaces) for reducing slippage of an crossbow user's foot or foot garment during, for example, the act of cocking the crossbow. A material with enhanced gripping characteristics may be, for example, a polymeric material (e.g., rubber, etc.) that may resiliently compress and conform to a sole of a crossbow user's foot or foot garment and/or may have surface characteristics (e.g., tackiness, compliance, etc.) that provide improved grip and/or friction.

Figure 13:
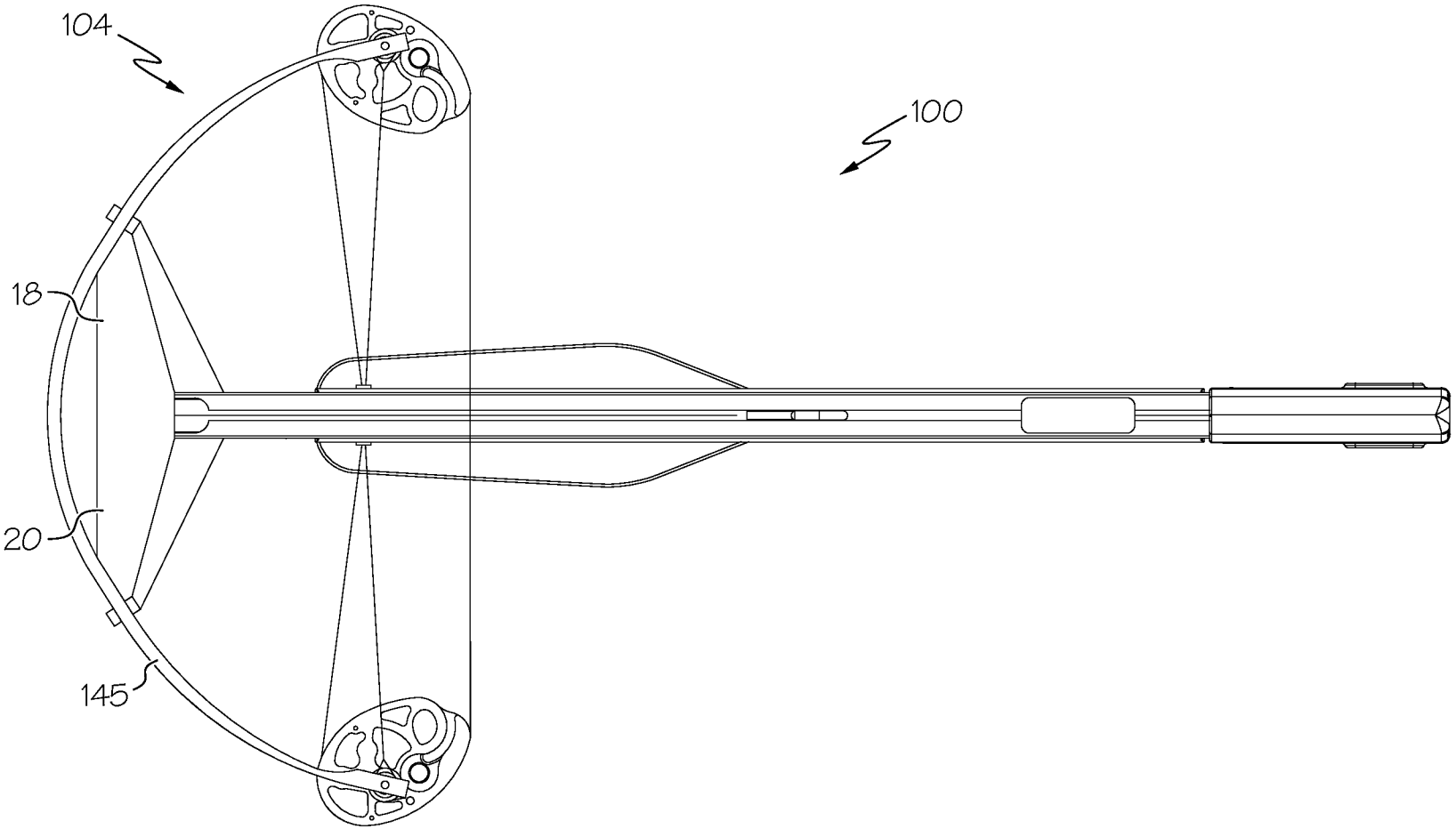
FIG. 13 shows a plan view of another embodiment of a crossbow.

A foot-engagement region as described herein can be provided on any suitable portion of a crossbow. FIG. 13 shows an example of a crossbow 100 having a continuous limb 145. The crossbow 100 comprises a foot-engagement region 18 supported by a limb 145. Desirably, the foot-engagement region 18 comprises a planar surface oriented orthogonal to the shooting axis. In some embodiments, the foot-engagement region 18 is integrally formed in the limb 145. In some embodiments, the foot-engagement region 18 comprises an accessory that is attached to the crossbow. In some embodiments, a first foot-engagement region 18 and a second foot-engagement region 20 are defined on opposite sides of the shooting axis. In some embodiments, the first foot-engagement region 18 and the second foot-engagement region 20 are defined on a continuous integral structure.

In some embodiments, a crossbow 100 comprises one or more foot engagement regions located forward of a limb (e.g. 116, 120, 145).

In one or more aspects of the present disclosure, a crossbow may include a stock assembly and a bow assembly operatively engaged with the stock assembly. With reference to FIG. 2, crossbow 100 includes a stock assembly 102 and a bow assembly 104 operatively engaged with stock assembly 102.

As shown in FIG. 2, a stock assembly of the present disclosure may include a rail 106 that defines a first longitudinal axis A (FIG. 1), a latch assembly 114 engaged with rail 106 and constructed and arranged to releasably hold bow string 124 in a cocked configuration. Stock assembly 102 may also include a trigger assembly 112 constructed and arranged to release (e.g., selectively release) the bow string from the latch assembly in order to shoot an arrow (not shown) from the crossbow toward, for example, a target.

In the present disclosure, any suitable stock assembly may employ, without limitation, any of a wide variety of latch assemblies known to one of skill in the art and any of a wide variety of trigger assemblies known to one of skill in the art.

Figure 6:
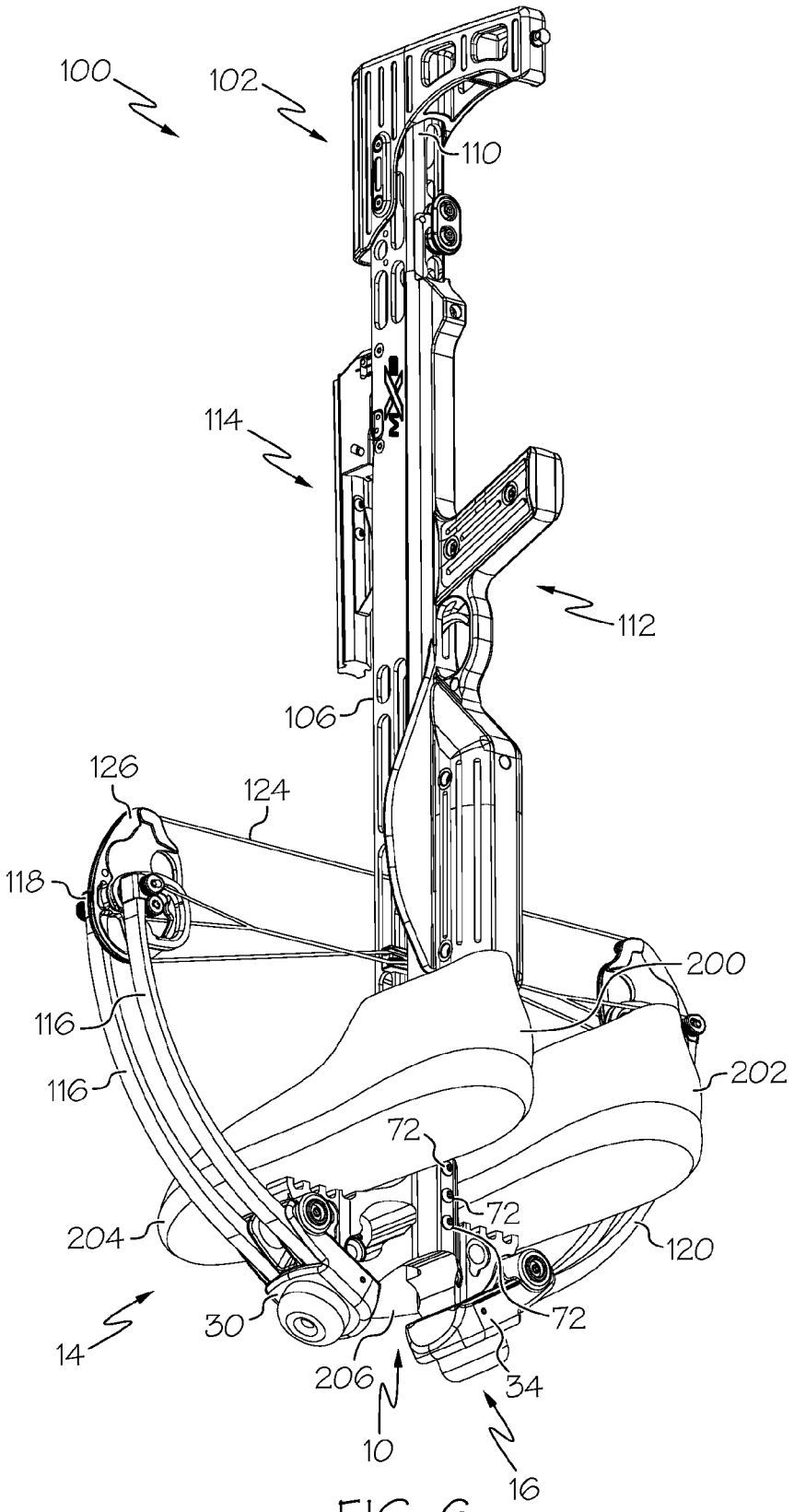
FIG. 6 is a left-bottom-front perspective view of at least one embodiment of a crossbow including a prod according to the present disclosure, depicting two feet or foot garments engaging the prod.
Figure 7:
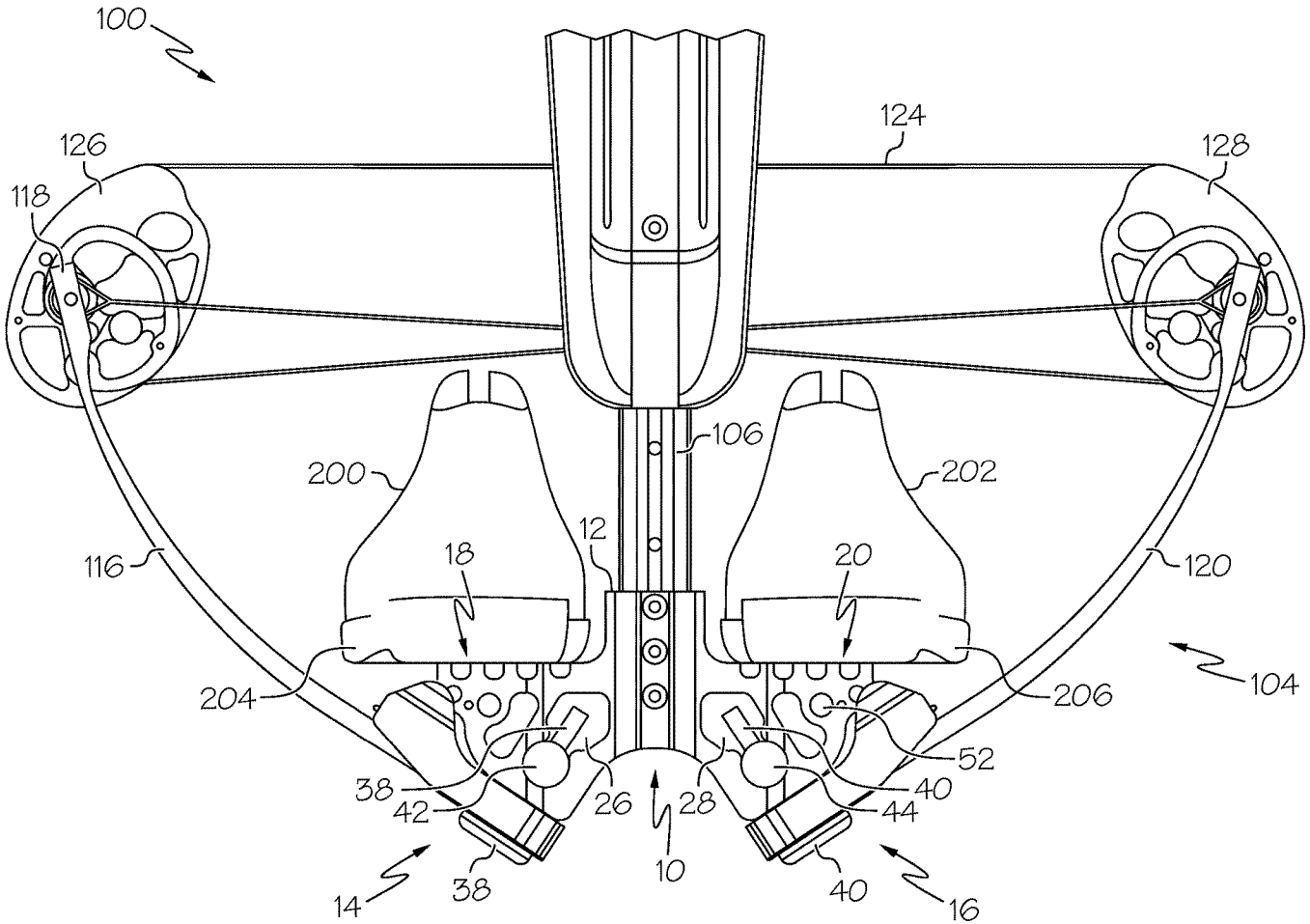
FIG. 7 is view B-B of FIG. 4, depicting a bottom view of at least one embodiment of a crossbow including a prod of the present disclosure, depicting two feet or foot garments engaging the prod.

Likewise, rail 106 may take a wide variety of shapes and designs known to one of skill in the art. In one or more embodiments the proximal end of rail 106 may engage the rail-engagement portion 12 of prod 10. Thus, a proximal end 108 or proximal portion of rail 106 may be constructed and arranged to have a shape and size that corresponds with a complementary shape and size of the rail-engagement portion 12 of prod 10. In one or more embodiments, the bottom of a distal end 108 of rail 106 may take a V-shaped configuration, which may be received by the top surface of a rail-engagement portion 12 of a prod 10, wherein the rail-engagement portion is a V-shaped rail-engagement portion 70 (FIG. 9). In one or more embodiments, one or more prod-rail fasteners 72 (e.g., bolts, screws, pins, etc.), as shown in FIGS. 6 and 9, may be used to secure prod 10 to rail 106. Any appropriate prod-rail fastener in any suitable quantity may be chosen by one of skill in the art. The V-shaped engagement features desirably provide for a self-aligning interface between the connected portions. A self-aligning interface is further discussed in U.S. patent application Ser. No. 14/021,655, filed Sep. 9, 2013, the entire disclosure of which is hereby incorporated herein by reference.

A crossbow of the present disclosure may include a bow assembly, wherein the bow assembly includes a prod (as described herein) and a bow operatively engaged with the prod. For example, a prod may include a first foot-engagement region and a second foot-engagement region, wherein both of the first and second foot-engagement regions extend in a common plane perpendicular to the longitudinal axis of the rail. For example, FIG. 8 depicts prod 10 with first and second foot-engagement regions 18, 20, wherein the first and second foot-engagement regions extend in a common plane perpendicular to the longitudinal axis A of rail 106.

With further reference to FIG. 8, crossbow 100 may include a bow assembly 104 that includes a first bow limb 116 that has a first limb end 118 and a second bow limb 120 that has a second limb end 122. Further, a bow assembly 104 may include a bowstring 124 operatively engaged with the first limb end 118 and the second limb end 122. Herein, operative engagement of the bowstring 124 with first and second limb ends 118 and 122 may be direct engagement (e.g., the bowstring tied to or otherwise in direct contact with first and second limb ends 118, 122, etc.) or by indirect engagement, for example, via cams, pulleys, grooved washers, bolts, axles, etc.

An exemplary dual cam compound crossbow is depicted in the figures. For example, FIG. 8 shows first cam assembly 126 at first limb end 118 and second cam assembly 128 at second limb end 122. The bow assembly 104 may include any suitable bow arrangement, for example, including a recurve bow assembly, a compound bow assembly, etc. A compound bow assembly may include any suitable type of compound bow arrangement, such as single cam, two-cam, 1.5/hybrid/CPS cam, etc. A compound bow assembly may further include a dual-synchronization arrangement, as disclosed by Darlington (U.S. Pat. No. 6,990,970), or a force vectoring anchor arrangement, as disclosed by McPherson (U.S. Pat. No. 8,020,544). The entire disclosures of Darlington (U.S. Pat. No. 6,990,970), McPherson (U.S. Pat. No. 8,020,544), and Trpkovski (U.S. Pat. Appl. Pub. No. 2010/0000504) are hereby incorporated herein by reference.

A crossbow of the present disclosure may include a prod having an integral first foot-engagement region, wherein the first foot-engagement region is optionally disposed between the bow (e.g., bow limbs 116, 120) and the bow string 124.

It may be noted that a prod of the present disclosure includes at least one foot-engagement portion for applying a counterforce while cocking the bowstring. Because the sole purpose of a dedicated foot stirrup is for applying a counterforce while cocking the bowstring, a crossbow, including a prod of the present disclosure, need not include a foot stirrup. Herein, "stirrup" means a loop, ring, or other construction that surrounds (e.g., encircles, circumscribes, etc.) a foot or foot garment, wherein the foot or foot garment is disposed within the loop, ring, or other construction and applies a force against an inside surface of the loop, ring, or other construction. It may be noted that a stirrup includes an inner surface for engaging a foot or foot garment and does not include a peripheral surface (e.g., does not include a surface facing outwardly from the periphery of the stirrup, does not include an outer peripheral surface, etc.) that further includes a foot-engagement region. In one or more embodiments of the present disclosure, a crossbow might not include a dedicated foot stirrup. That is, one or more embodiments of a crossbow may include a prod that includes a foot-engagement region that does not surround (e.g., encircle around the bottom, sides, and top of) a crossbow user's foot or foot garment.

The crossbows and prods of the present disclosure may provide one or more advantages. Cocking a crossbow while having, for example, two feet engage the prod may provide a more stable and safe cocking action. The ability to engage a prod with two feet/legs may also allow for higher cocking forces, because two feet/legs provide counterforce for cocking, which may permit higher arrow velocities. The two-foot method also balances forces laterally.

In one or more embodiments in which the foot-engagement region is disposed between the bow limbs and the bowstring, the crossbow may be constructed without a foot stirrup protruding from the front end of the crossbow, which may reduce the size (e.g., weight, volume, etc.) of the crossbow, which may permit easier storage, transport, and operation. A prod having a unitary construction that includes a foot-engagement region surface may provide one or more advantages, such as, ease of construction, fewer parts, increased durability and lifespan of a prod, and/or the ability to withstand additional wear relative to constructions having an attached foot-engagement region surface. Moreover, one or more advantages may be provided by a prod having foot-engagement protrusions and recesses that may be configured to more securely engage a foot by, for example, reducing the likelihood of a foot slipping off of the foot-engagement region while cocking the crossbow, resulting in a safer crossbow.

In some embodiments, a foot engagement region as described herein is provided on a crossbow accessory, and the accessory is attached to a suitable portion of the crossbow. In one or more aspects of the present disclosure, a crossbow accessory may include a rail-engagement portion configured to engage a rail extending along a longitudinal axis extending proximally from the rail-engagement portion; and a textured peripheral surface including at least two foot-engagement regions, wherein the at least two foot-engagement regions may be disposed on opposing sides of the rail-engagement portion. The present disclosure includes one or more embodiments in which a step-accessory may be provided as an after-market accessory to a crossbow, wherein the step-accessory may be installed on a crossbow rail via the rail-engagement portion and may provide a textured peripheral surface including at least two foot-engagement regions. In various embodiments as an accessory, the accessory may or may not engage a bow assembly/portion of the crossbow (e.g., a bow, one or more bow limbs, etc.).

In one or more embodiments, a crossbow accessory may include a bow-engagement portion configured to engage a bow (or one or more bow limbs) and may further include a textured peripheral surface including at least two foot-engagement regions. The at least two foot-engagement regions may be disposed on opposing sides of a rail of a crossbow. In various embodiments as an accessory, the accessory may or may not engage a rail, or another portion of a stock assembly.

In one or more embodiments of the present disclosure, a prod may be configured to engage a vibration dampener, for example as described in U.S. Pat. No. 6,257,220, the entire disclosure of which is hereby incorporated herein by reference. For example, a prod 10 can comprise one or more apertures into which a vibration dampener (not shown) may be received and secured. Any of a wide variety of apertures and corresponding vibration dampeners may be known to one of skill in the art and may be suitable for use in one or more embodiments of the present disclosure.

In one or more embodiments, the prod may be provided as an integral portion of the rail (or stock assembly) and may include a bow-engagement portion. In one or more embodiments, the prod may be provided as an integral portion of the bow assembly (i.e., the prod forms a portion of the bow) and may include a rail-engagement portion.

In one or more embodiments, a prod of the present disclosure may be configured with a limb nut aperture (e.g., a cylindrical aperture) into which a limb nut may be received, wherein the limb nut may have a cylindrical outer surface having a centrally located longitudinal axis. In one or more embodiments, the limb nut may include a limb bolt aperture, having a longitudinal axis, extending therethrough that is transverse to the cylinder's longitudinal axis. The limb bolt aperture of the limb nut may receive, for example, a threaded end of a limb bolt therein. The limb bolt aperture may be threaded and may engage the corresponding thread of a limb bolt. In one or more embodiments, the limb bolt may extend through the limb nut and be secured on the opposing side using, for example, a second nut or other fastening member. FIG. 8 shows a prod 10 including a first limb nut aperture 26 and a second limb nut aperture 28. FIGS. 7, 11, 11*a*, 12, and 12*a* depict a crossbow 100 that includes a prod 10 according to the present disclosure, wherein prod 10 includes first and second limb nut apertures 26, 28 having disposed therein first and second limb nuts 42 and 44 engaging first and second limb bolts 38, 40.

Figure 11:
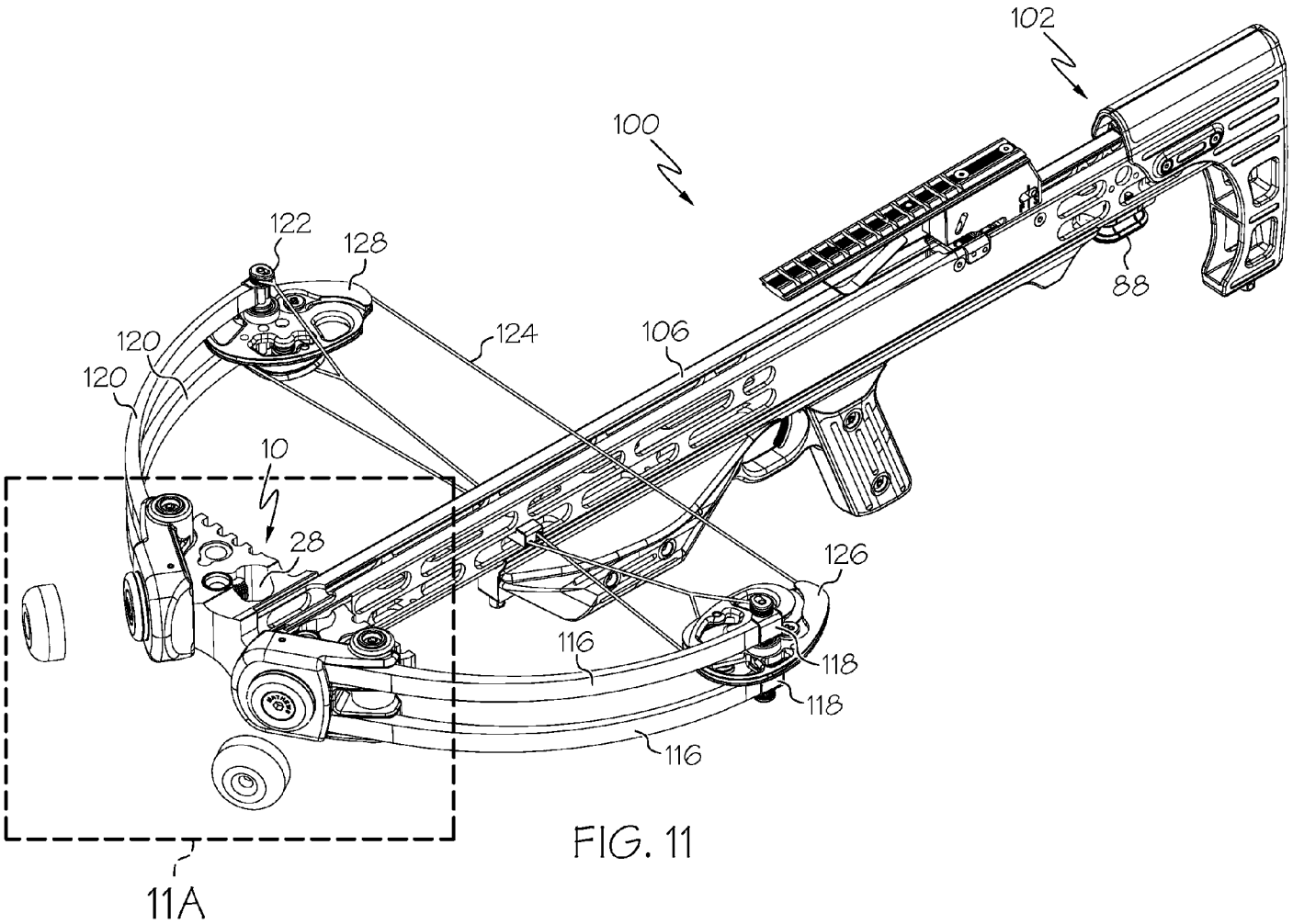
FIG. 11 is a left-top-front perspective view of at least one embodiment of a crossbow including a prod of the present disclosure, shown with detached caps, which may, when attached, cover and/or protect the crossbow limb bolts and limb bolt washers when the crossbow is being cocked.
Figure 11A:
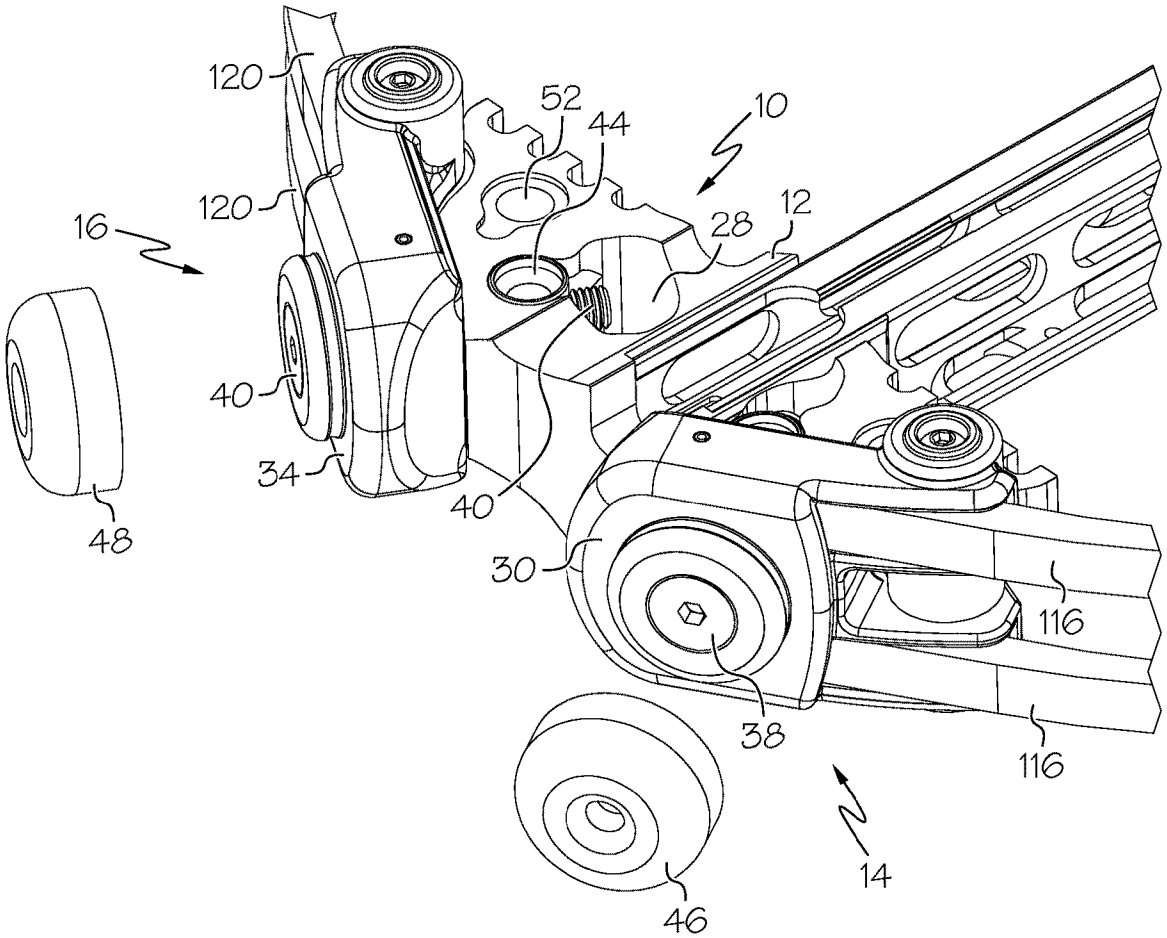
FIG. 11*a* is an enlarged close-up left-top-front perspective view of a portion of at least one embodiment of a crossbow including a prod of the present disclosure, shown with detached caps, which may, when attached, cover and/or protect the crossbow limb bolts and limb bolt washers when the crossbow is being cocked.
Figure 12:
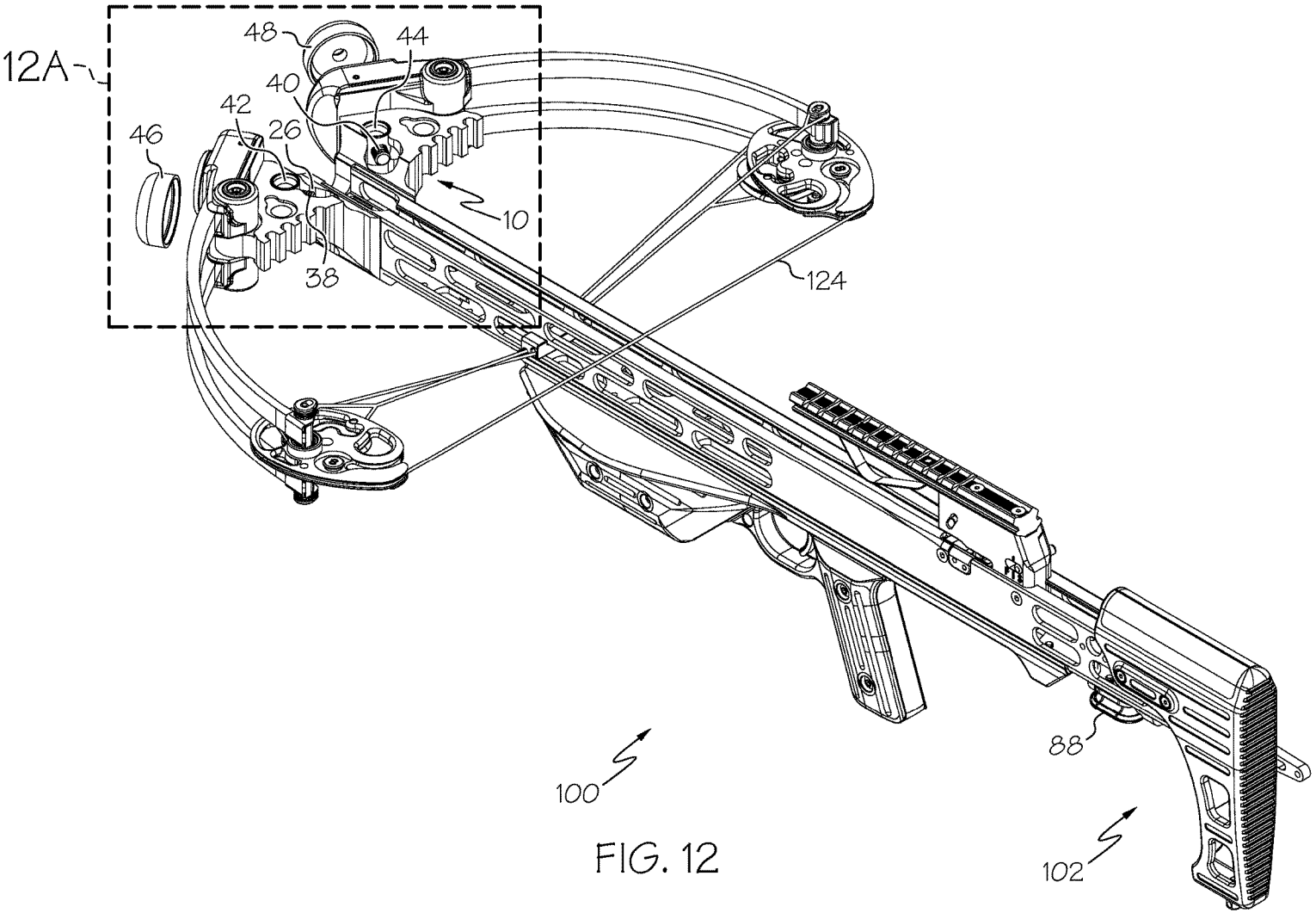
FIG. 12 is a left-top-rear perspective view of at least one embodiment of a crossbow including a prod of the present disclosure, shown with detached caps, which may, when attached, cover and/or protect the crossbow limb bolts and limb bolt washers when the crossbow is being cocked.
Figure 12A:
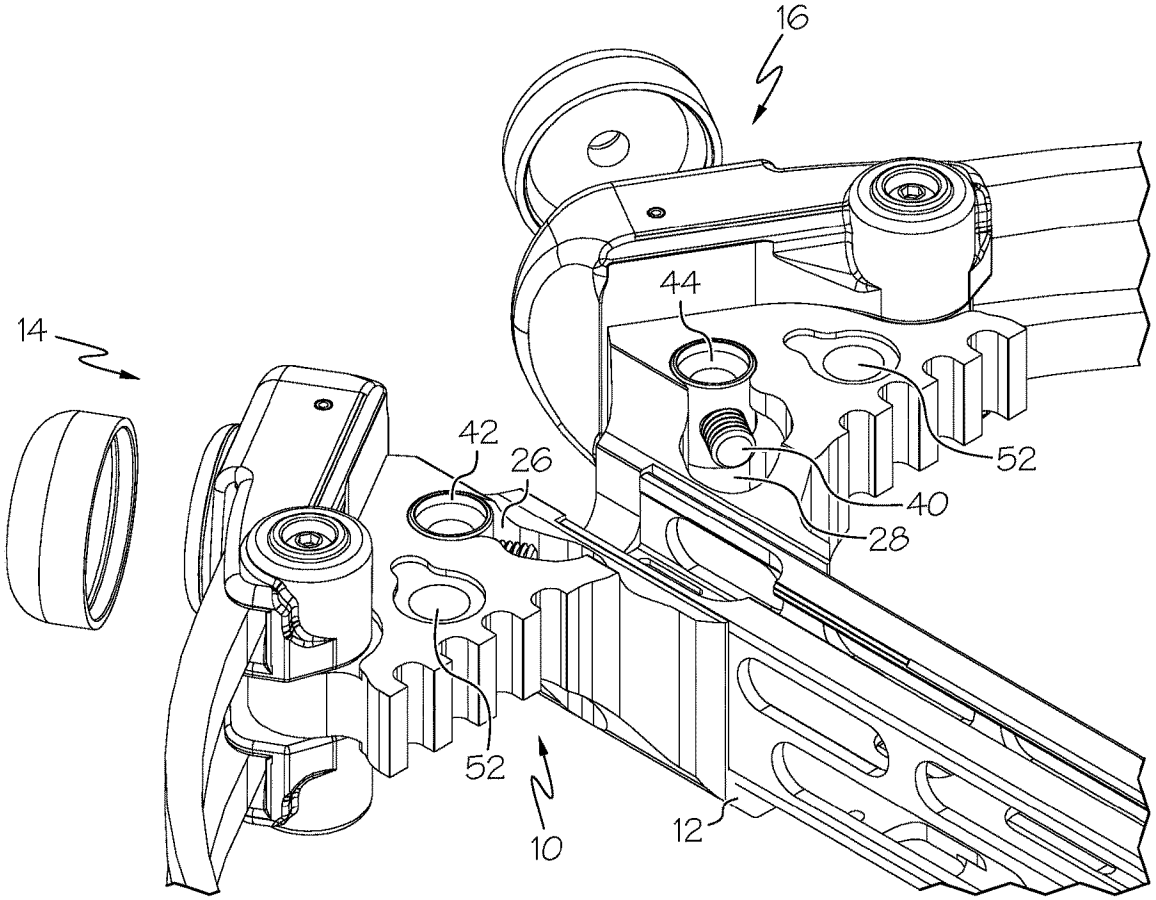
FIG. 12*a* is an enlarged close-up left-top-rear perspective view of a portion of at least one embodiment of a crossbow including a prod of the present disclosure, shown with detached caps, which may, when attached, cover and/or protect the crossbow limb bolts and limb bolt washers when the crossbow is being cocked.

In one or more embodiments, one or both of the first and second bow-engagement portions may include a bow limb cup secured by a limb bolt. In some embodiments, a bow limb cup is configured to pivot on portion of a prod. For example, FIG. 8 depicts a prod 10 including a first bow-engagement portion 14 that includes a first bow limb cup 30 mounted to prod 10 and arranged to pivot on a protrusion 32. FIG. 11*a* shows a first limb bolt 38 that may extend through the first bow limb cup 30, a portion of the prod 10 and be secured to the first limb nut 42 (not shown). FIG. 8 also depicts a second bow-engagement portion 16 that includes a second bow limb cup 34, secured to prod 10 and pivotable on protrusion 36. FIG. 11*a* shows a second limb bolt 40 that may extend through the second bow limb cup 34, a portion of the prod 10, and engage the second limb nut 44. In some embodiments, adjustment of a limb bolt 40 with respect to its associated limb nut 44 causes a pivoting of the limb cup 34 with respect to the prod 10. The pivoting in turn results in more, or less, flex in the limbs (e.g. 120), which can change the draw weight of the bow.

In some embodiments, limbs 116, 120 are receivable in a limb cup 30, 34 without removing the limb cup 30, 34 from the prod 10. For example, a suitable limb cup and limb arrangement is taught in U.S. patent application Ser. No. 12/916,261, filed Oct. 29, 2010, the entire disclosure of which is hereby incorporated herein by reference in its entirety.

Figure 5:
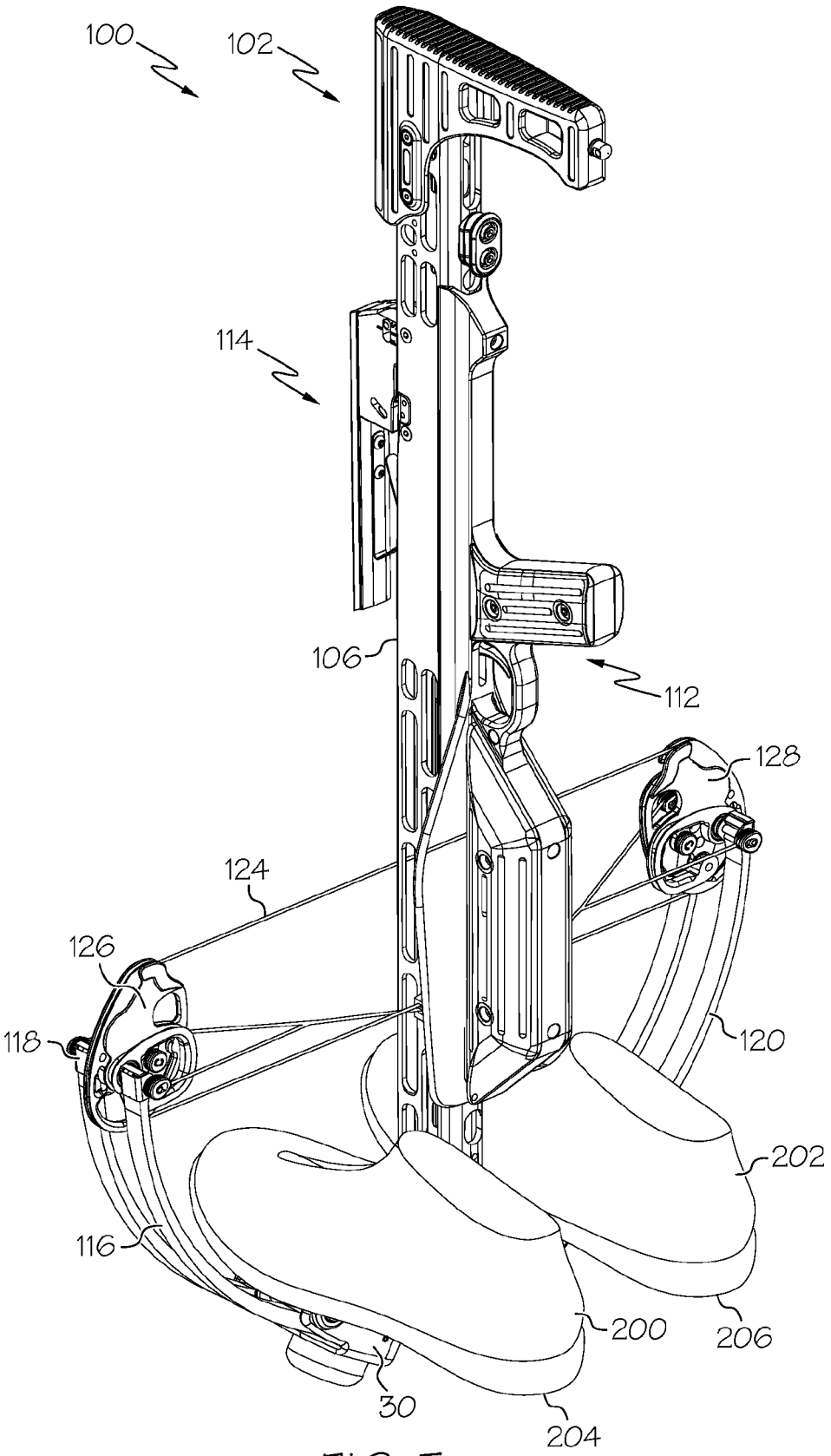
FIG. 5 is a left-bottom-rear perspective view of at least one embodiment of a crossbow including a prod according to the present disclosure, depicting two feet or foot garments engaging the prod.

Also shown in FIGS. 11, 11*a*, 12, and 12*a* are first and second cover caps 46, 48, each of which may be secured over first and second limb bolts 38, 40. In the present disclosure, one or more cover caps 46, 48 may be used to cover and protect one or more limb bolts, one or more bow limbs, and/or one or more bow limb cups during the act of cocking the crossbow. With reference to FIG. 5, a crossbow user may cock the crossbow by orienting the crossbow such that the front end of the crossbow rests against the ground or floor. A crossbow user may place one or more feet or foot garments against the foot-engagement surfaces of the prod to keep the front of the crossbow stationary on the ground or floor while the crossbow user pulls the bow string toward the latch assembly. Depending on the configuration of the bow assembly, it may be that one or more limb bolts, bow limbs, and/or bow limb cups may contact the ground during such a cocking procedure, which may cause structural and/or aesthetic damage thereto. Thus, one may employ one or more cover caps 46, 48 to cover and protect the limb bolts and which may be sized and configured to extend proximally such that the one or more cover caps 46, 48 would contact the ground or floor during the cocking procedure described above. The exterior surface of the one or more cover caps 46, 48 may be shaped and configured in order to further stabilize the crossbow against the ground or floor during the cocking procedure.

In some embodiments, the crossbow 100 is arranged such that the arrow passes between a first bow limb 116 and a second bow limb 120. Desirably, the limbs 116, 120 are spaced to allow an arrow to freely pass between the limbs 116, 120 without contact. In some embodiments, the prod 10 includes an aperture (e.g., cavity, recess, etc.) for an arrow or bolt to pass through when the crossbow 100 is fired.

When the bow assembly 104 includes a continuous bow spanning between first bow end 118 and second bow end 122, a moment transferring connection is not required between the prod 10 and bow, but may be used if desired. Thus, in some embodiments, a continuous bow may be attached to the crossbow 100 (e.g. to the prod 10) via a single fastener (e.g., a bolt) or a plurality of fasteners.

In some embodiments, a continuous bow may be concave. In one or more embodiments, a continuous bow may include both concave and convex portions and may include one or more inflection points.

In some embodiments, a crossbow comprises an anchor 88 (see e.g. FIGS. 11&12), which can be used with a cocking rope. In some embodiments, an anchor 88 is located below the rail longitudinal axis A. In some embodiments, a crossbow comprises anchors as disclosed in US patent application Attorney Docket No. M55-15780-US02, the entire disclosure of which is hereby incorporated herein by reference.

An example of a crossbow having one or more limbs that span continuously from axle-to-axle (or between bowstring ends) is disclosed in U.S. patent application Ser. No. 13/480,774, filed May 25, 2012, the entire disclosure of which is hereby incorporated herein by reference.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the subject matter of the present disclosure should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim 1f such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

Those skilled in the art may recognize other equivalents to the specific embodiment described herein which equivalents are intended to be encompassed by the claims attached hereto.

All published documents, including all U.S. patent documents, mentioned anywhere in this application are hereby expressly incorporated herein by reference in their entirety. Any co-pending patent applications mentioned anywhere in this application are also hereby expressly incorporated herein by reference in their entirety.

The invention claimed is:

1. A crossbow comprising:

a stock assembly comprising:

a rail defining a shooting axis;

a latch assembly engaged with the rail and constructed and arranged to releasably hold a bow string in a cocked configuration; and a trigger assembly constructed and arranged to release the bow string from the latch assembly; and a bow assembly operatively engaged with the stock assembly, wherein the bow assembly comprises:

a prod comprising a first foot-engagement region, a second foot-engagement region and a cavity, each foot engagement region comprising a plurality of alternating ridges and recesses, wherein said prod does not comprise a closed foot stirrup structure;

a bow operatively engaged with the prod, wherein the bow comprises:

a first bow limb that has a first bow end;

a limb bolt engaged with a limb nut, the limb nut oriented in the cavity;

a second bow limb that has a second bow end; and a bow string operatively engaged with the first bow end and the second bow end;

wherein a lateral distance between the shooting axis and the limb nut is less than a lateral distance between the shooting axis and a portion of the first foot-engagement region.

2. The crossbow of claim 1, wherein the first foot-engagement region is integral with the prod.

3. The crossbow of claim 1, said limb nut having a cylindrical shape, said cavity shaped to receive said limb nut.

4. The crossbow of claim 1, comprising a cover cap, said limb bolt comprising a bolt head, said cover cap engaged to said bolt head.

* * * * *